US007971742B2

(12) United States Patent
Kreider

(10) Patent No.: US 7,971,742 B2
(45) Date of Patent: Jul. 5, 2011

(54) DEVICE FOR CONTAINMENT, PROTECTION AND EASY INSTALLATION AND REMOVAL OF A LIQUID HANDLING SYSTEM

(76) Inventor: Stephen Lynn Kreider, Carlton, WA (US)

( * ) Notice: Subject to any disclaimer, the term of this patent is extended or adjusted under 35 U.S.C. 154(b) by 1003 days.

(21) Appl. No.: 11/714,518

(22) Filed: Mar. 6, 2007

(65) Prior Publication Data

US 2008/0087671 A1 Apr. 17, 2008

Related U.S. Application Data

(60) Provisional application No. 60/851,712, filed on Oct. 14, 2006.

(51) Int. Cl.

| | |
|---|---|
| ***F16L 25/06*** | (2006.01) |
| ***F16L 37/26*** | (2006.01) |
| ***B65D 21/028*** | (2006.01) |
| *B65D 88/76* | (2006.01) |

(52) U.S. Cl. ..... 220/23.89; 220/484; 220/661; 285/325

(58) Field of Classification Search ..... 220/23.89, 220/484, 661; 285/325

See application file for complete search history.

(56) References Cited

U.S. PATENT DOCUMENTS

| | | | | | |
|---|---|---|---|---|---|
| 529,638 | A | * | 11/1894 | Anderson | 220/484 |
| 1,131,102 | A | * | 3/1915 | Aldrich | 220/484 |
| 2,247,936 | A | * | 7/1941 | Bishop | 174/17 R |
| 2,689,611 | A | * | 9/1954 | Martinson | 166/85.2 |
| 2,944,563 | A | * | 7/1960 | De Blasio et al. | 137/312 |
| 3,365,215 | A | * | 1/1968 | Arzt et al. | 285/24 |
| 3,392,867 | A | * | 7/1968 | Morris | 220/484 |
| 3,593,344 | A | * | 7/1971 | Logsdon | 4/679 |
| 3,805,891 | A | * | 4/1974 | Reinhard et al. | 166/85.2 |
| 3,972,440 | A | * | 8/1976 | Warren | 220/484 |
| 4,005,253 | A | * | 1/1977 | Walter | 174/37 |
| 4,065,020 | A | * | 12/1977 | Carson | 220/484 |
| 4,230,234 | A | * | 10/1980 | Taylor | 220/484 |
| 4,308,000 | A | * | 12/1981 | Oakes | 417/360 |
| 4,416,549 | A | * | 11/1983 | Kretschmer | 366/190 |
| 4,564,041 | A | * | 1/1986 | Kramer | 137/315.01 |
| 4,580,817 | A | * | 4/1986 | Bonino et al. | 285/325 |
| 4,850,389 | A | * | 7/1989 | Moss | 137/364 |
| 4,872,575 | A | * | 10/1989 | Kobilan | 220/3.3 |
| 4,886,426 | A | * | 12/1989 | Surinak | 417/360 |
| 5,078,171 | A | * | 1/1992 | Moore et al. | 137/15.08 |
| 5,096,006 | A | * | 3/1992 | Howard | 177/134 |
| 5,383,689 | A | * | 1/1995 | Wolfe, Sr. | 285/124.3 |
| 5,507,628 | A | * | 4/1996 | Masse et al. | 417/360 |
| 5,700,041 | A | * | 12/1997 | Andre et al. | 285/325 |
| 5,788,291 | A | * | 8/1998 | Williams et al. | 285/325 |
| 5,791,098 | A | * | 8/1998 | Thomas | 52/169.6 |

(Continued)

*Primary Examiner* — J. Gregory Pickett
*Assistant Examiner* — Ned A Walker

(57) ABSTRACT

A containment device for a liquid handling system is presented. The devise has a vault having a cavity, a closed bottom and an open top. A supporting device having a first half of a quick connect system connected to external plumbing is positioned in a lower portion of the cavity and secured to the vault to provide support for a weight of the liquid handling system. A bracket having a second half of a quick connect system connected to internal plumbing for the liquid handling system is configured to retain the liquid handling system, contact the supporting device when the bracket and liquid handling system is lowered into the cavity and mate the first second halves of the quick connect system allowing liquid to flow from the external plumbing to the internal plumbing. A lid is secured to the top for minimizing the intrusion of environmental elements into the vault.

13 Claims, 7 Drawing Sheets

U.S. PATENT DOCUMENTS 6,321,928 B1 * 11/2001 Goldenstein et al. ..... 220/484
6,362,419 B1 * 3/2002 Gallagher et al. ..... 174/37
6,749,080 B1 * 6/2004 White ..... 220/484
6,772,566 B1 * 8/2004 Machledt et al. ..... 52/169.6
7,165,767 B2 * 1/2007 Graef et al. ..... 271/164

* cited by examiner

DEVICE FOR CONTAINMENT, PROTECTION AND EASY INSTALLATION AND REMOVAL OF A LIQUID HANDLING SYSTEM

CROSS-REFERENCE TO RELATED APPLICATIONS

The present Utility patent application claims priority benefit of the U.S. provisional application for patent Ser. No. 60/851,712, entitled "A Device for Containment and Protection of a Liquid Handling System" and filed on Oct. 14, 2006 under 35 U.S.C. 119(e).

FIELD OF THE INVENTION

The present invention relates generally to water systems. More particularly, the invention relates to a device for the containment and protection of a liquid handling system enabling easy installation and removal.

BACKGROUND OF THE INVENTION

Several issues have been identified with liquid handling systems. One of these problems is that fluid pumping devices installed in homes or other buildings leave room for extensive damage by defective or worn out devices. Defects such as, but not limited to, failed and leaking pressure tanks and bad pressure switches may cause pressure relief valves to release water into the building and can cause water damage and mold issues inside the building. Another issue is that valuable building space is occupied by liquid handling systems. Other problems include, without limitation, limited access to the device due to physical building limitations, and hazards caused by the proximity of electrical devices. These issues may be avoided by housing the liquid handling system in a containment device outside of the building.

The current art provides some methods for housing liquid handling systems. For example, without limitation, separate "pump houses" may be built to house liquid handling systems. However, pump houses are expensive to construct and may not be appealing in a yard. In cold climates, pump houses must be heated to prevent freezing. In warm climates, pump houses tend to cause the liquid to warm up, and if this is a drinking water system, it may not to pleasing or refreshing to drink warm water. Also, pump houses tend to be confining and tend to collect everything else around the house or facility including, without limitation, toxic items such as, but not limited to, herbicides, and pesticides that should not be stored near water systems. This collection of objects also creates problems and safety issues with servicing the equipment of the liquid handling system. Pump houses are often dirty and filled with insects. Pump houses can become homes for pests such as, but not limited to, rodents, poisonous spiders, snakes, etc., creating additional health hazards. Also, pump houses require maintenance themselves including, without limitation, regular painting, cleaning, and roof maintenance.

Another solution is to house liquid handling systems in concrete "well rings" buried in ground. Concrete rings allow for the placement of a liquid handling system in-ground and protect the liquid handling system from freezing and resist vandalism, although less expensive than pump houses. However, concrete rings are still costly. Concrete rings are very heavy and may require a boom truck or truck-trailer to deliver and may require a crane, backhoe or similar device to set in-ground. Use of concrete rings requires entering a confined space to work on the water system device. Confined space issues include, without limitation, hazardous gasses, and electrical safety issues that actually may not meet electrical codes. Also, these concrete rings are not very tight, allowing nuisances such as, but not limited to, bugs, snakes, water, etc. to enter the concrete ring. It is also difficult to get plumbing through the concrete ring. The lids of these concrete rings are often very heavy and may require hoisting equipment to remove. The use of concrete rings does eliminate or minimize potential water damage in structures from leaking devices, and provide some protection from weather. Use of concrete rings in ground may be more aesthetically pleasing than a building, but is still somewhat of an eyesore. Furthermore, with the advent of new variable speed pumping systems and computerized pumping systems, it is necessary to have devices as big as concrete rings to house these smaller components.

In view of the foregoing, there is a need for an improved containment device for a liquid handling system that protects the liquid handling system from the elements and pests, is simpler to install than current containment devices, and provides easy access to the liquid handling system.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1 shows a front view; FIG. 2 shows a side perspective view, and FIG. 3 shows an exploded view;

Figure 1:
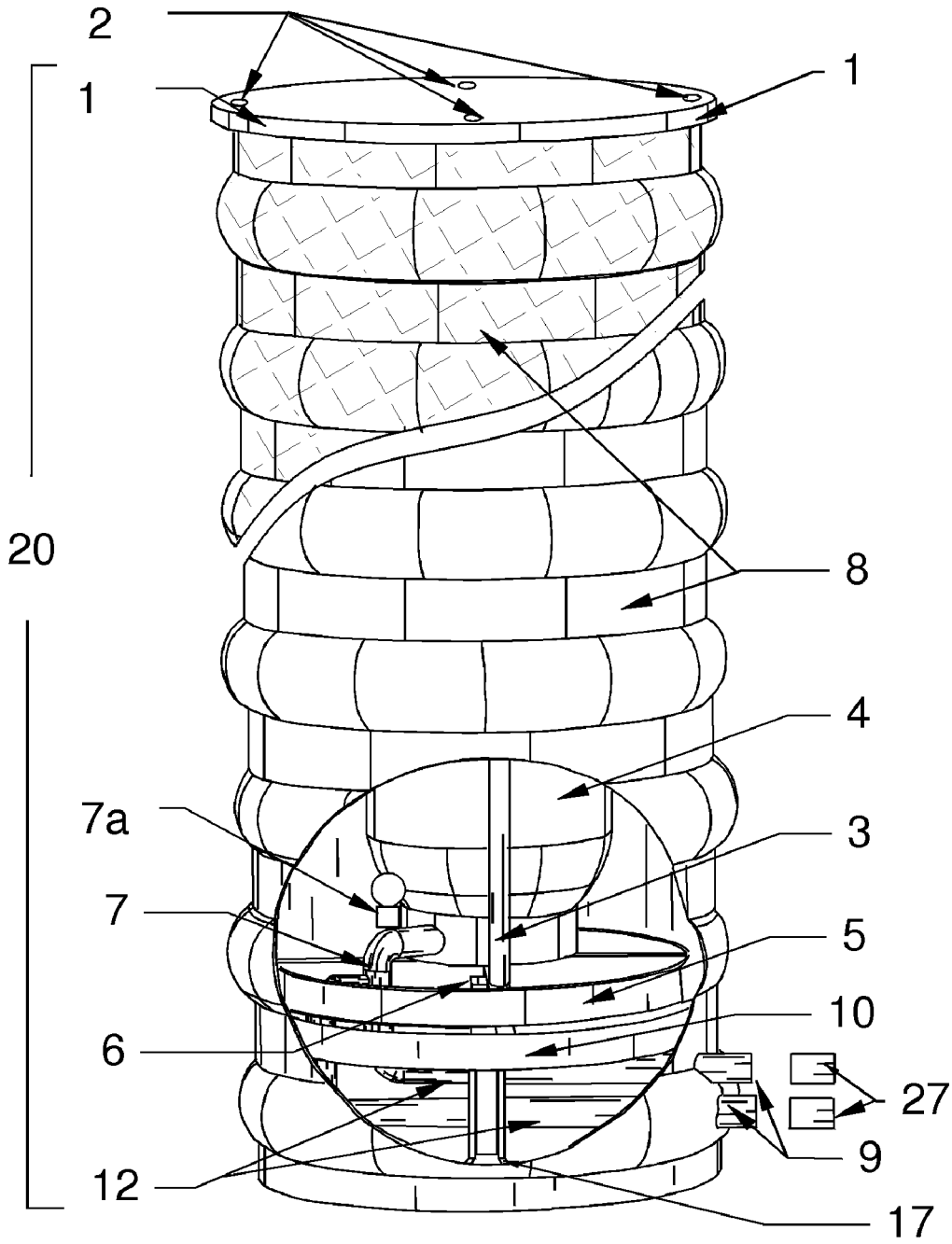
FIGS. 1, 2, and 3 illustrate an exemplary vault assembly for a liquid handling system containment device, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a device for containment and protection of a liquid handling system is presented.

In one embodiment, a containment device for a liquid handling system is presented. The devise comprises a vault comprising a cavity of sufficient dimensions to contain at least the liquid handling system, a closed bottom and an open top. A supporting device comprising a first half of a quick connect system connected to external plumbing is positioned in a lower portion of the cavity and secured to the vault in a manner to provide support for a weight of the liquid handling system. A bracket comprising a second half of a quick connect system connected to internal plumbing for the liquid handling system is configured to retain the liquid handling system, contact the supporting device when the bracket and liquid handling system is lowered into the cavity and mate the first second halves of the quick connect system allowing liquid to flow from the external plumbing to the internal plumbing. A lid is secured to the top for minimizing the intrusion of environmental elements into the vault. In another embodiment, the device further comprises an alignment feature for guiding the bracket to properly contact the base. In another embodiment, the device further comprises an additional quick connect system for plumbing of regulation devices for the liquid handling system such that the regulation devices can be removed from the vault without removing the liquid handling system. In an embodiment, the regulation device is a gauge. In a further embodiment, the device further comprises a means for lowering and lifting the bracket and liquid handling system in the cavity. In an embodiment, the means for lowering and lifting is a lifting pipe attached to the bracket. In another embodiment, the external plumbing is attached to mainlines outside the vault. In a further embodiment, the vault is fabricated in a manner suitable for being buried below ground. The device is further fabricated to minimize distortions from soil pressure. In another embodiment, the device further comprises fasteners for securing the lid to the top. In yet another embodiment, the bracket retains the liquid handling system by fastener means. In another embodiment, the vault is constructed of a plastic material or galvanized steel. In another embodiment, the lid is constructed of molded plastic or fabricated metal.

In another embodiment, a containment device for a liquid handling system is presented. The device comprises a means for housing the liquid handling system, a means for quick connecting and disconnecting the liquid handling system from external plumbing, and a means for protecting contents of the housing. In a further embodiment, the device further comprises a means for lowering and lifting the liquid handling system in the housing. In yet another embodiment, the device further comprises a means for guiding the lowering of the liquid handling system. In still another embodiment, the device further comprises a means for minimizing distortions to the housing when the device is buried under ground.

In another embodiment, a quick connect device for use with a containment device for a liquid handling system is presented. The device comprises a connector shoe comprising a flat area with a plurality of openings for accepting a plurality of plumbing connectors on a first side of the connector shoe, the connector shoe retaining a plurality of O-ring type sealers in groves on a second side and placed circumferentially about the openings, and a connector base comprising a flat area with a plurality of openings for accepting a plurality of plumbing connectors on a first side, a slotted perpendicular boss along two edges of a second side, the boss dimensioned and positioned to hold in place the connector shoe, when the connector shoe is inserted between the bosses, and align the plurality of openings of the connector shoe and the connector base such that fluids can pass between the connector shoe and the connector base and the sealers prevent leaking. In another embodiment, the connector shoe comprises a regulation device connected to at least one opening. In another embodiment, the regulation device is a gauge.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

Embodiments of the invention are discussed below with reference to the Figures. However, those skilled in the art will readily appreciate that the detailed description given here with respect to these figures is for explanatory purposes as the invention extends beyond these limited embodiments. For example, without limitation, it should be appreciated that those skilled in the art will, in light of the teachings of the present invention, recognize a multiplicity of alternate and suitable approaches, depending on the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Embodiments of the present invention provide liquid handling system containment devices that reduce cost of installation, simplify service and replacement of liquid handling systems, create protected space for liquid handling systems, and protect liquid handling systems from the elements such as, but not limited to, rain, snow, freezing, and heat. These embodiments also minimize vandalism by being out of site and having a secure lid. The lid in these embodiments may also be colored to minimize visibility of the containment device.

The preferred embodiment of the present invention is designed to hold a liquid handling system by the use of quick connect devices, enabling easy removal of the liquid handling system for service and replacement. No entrance into the vault is required. By servicing the liquid handling system components above ground, the need to enter the containment device is eliminated. Therefore, confined space is not an issue with the preferred embodiment, and not having to enter the vault eliminates hazardous gasses issues. Not entering the containment device also generally climinates clear area issues for electrical appliances needed, for example, without limitation, pressure switches, disconnects, junction boxes, breaker panels, etc.

Figure 2:
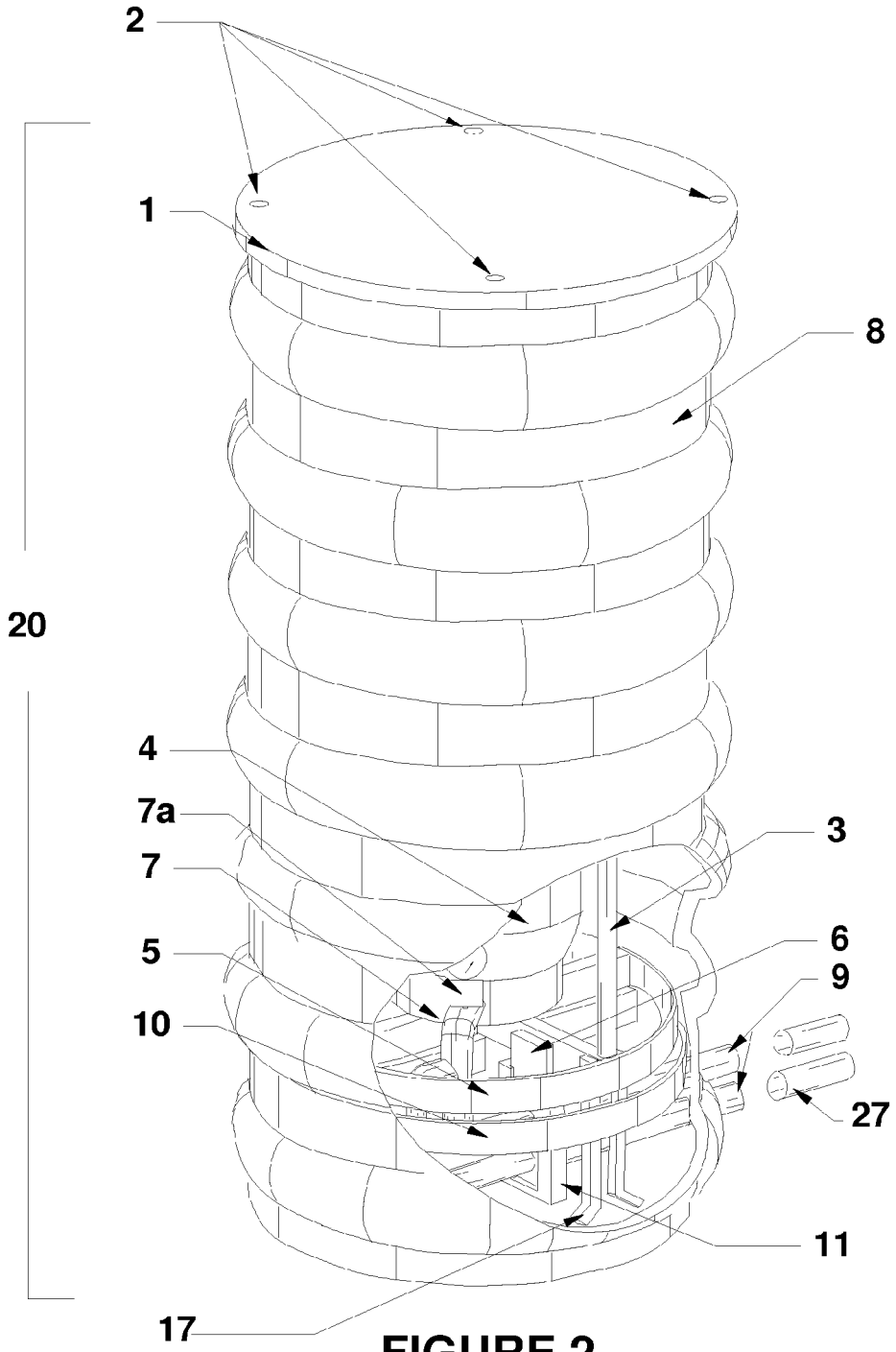
Figure 3:
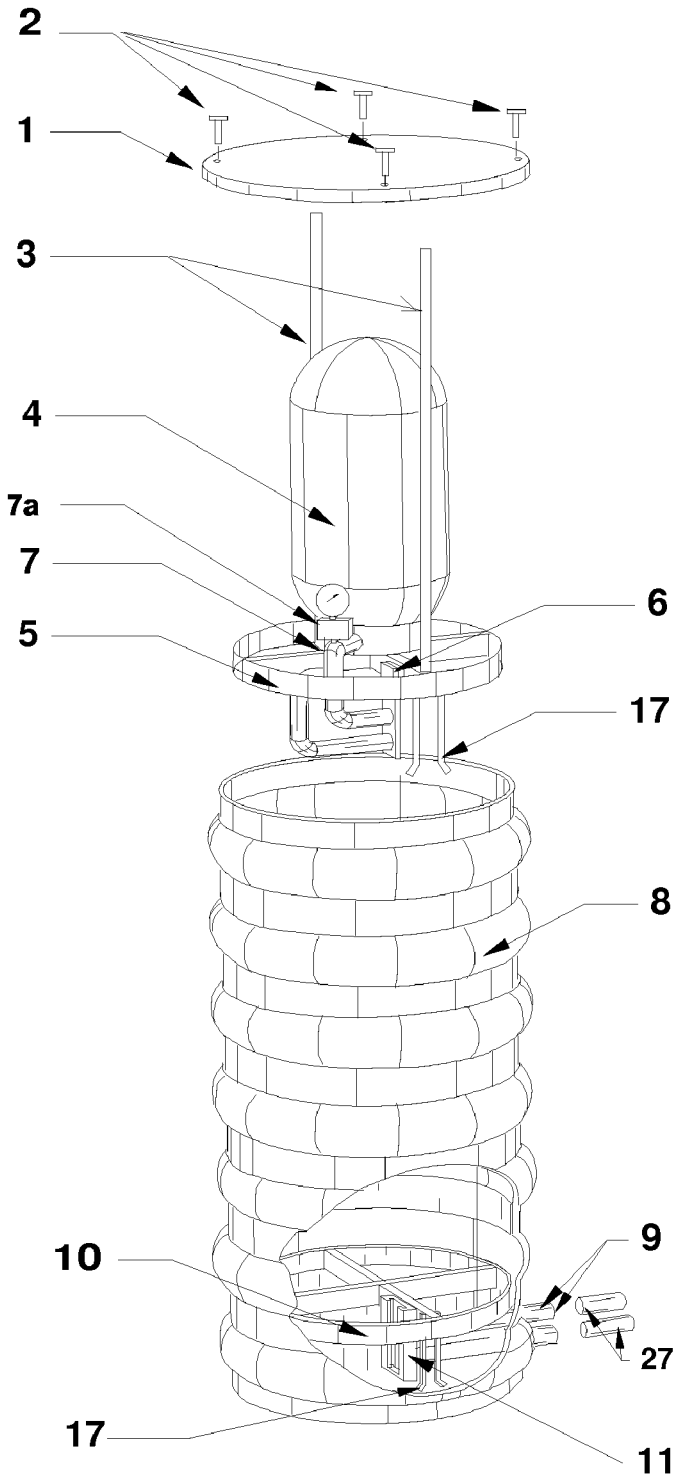

FIGS. 1, 2, and 3 illustrate an exemplary vault assembly 20 for a liquid handling system containment device, in accordance with an embodiment of the present invention. FIG. 1 shows a front view; FIG. 2 shows a side perspective view, and FIG. 3 shows an exploded view. The present embodiment comprises vault assembly 20 that houses liquid handling system devices such as, but not limited to, pressure tanks, pumps, filters, etc., in a clean, safe place that is weather resistant, for example, without limitation, resistant to heat, freezing, rain, snow, etc. The present embodiment enables easy initial installation and easy future repair and maintenance.

In the present embodiment, vault assembly 20 is comprised of a molded or fabricated vault 8 of adequate construction to withstand soil pressures to prevent distortion or collapsing when buried underground up to a lid 1. Vault 8 is preferably constructed of a plastic or galvanized steel, but may be constructed of various alternate materials such as, but not limited to, aluminum or other metals. Vault 8 houses a quick connect system and a liquid handling device 4 connected to the quick connect system. The top of vault 8 has a ridge that enables lid 1 to seal to vault 8 and areas adequate to fasten lid 1 to vault 8 with fasteners 2 for security and safety. Fasteners 2 are designed to make removal of lid 1 difficult, adding to security. Fasteners 2 may be, for example, without limitation, latches, hooks, or bolts passing through lid 1 and threaded into vault 8, to secure lid 1 to vault 8. Lid 1 may be constructed of molded plastic or fabricated metal dependant on traffic, security, and aesthetic needs.

Vault 8 comprises a bottom to prevent pests from entering and provisions for drainage that may be needed. A quick connect base 11, the first half of the quick connect system, is attached to a supporting device 10 that is also attached to other areas of vault 8 to support the weight of the liquid handling system being installed in vault 8. Quick connect base 11 is bolted or welded to vault 8 to hold quick connect base 11 square. Liquid handling device 4 connects to bracket 5 by means such as, but not limited to clamps or bolts. Bracket 5 holds the second half of the quick connect system, a quick connect shoe 6, and holds quick connect shoe 6 inline with quick connect base 11, assuring proper alignment and support of liquid handling device 4. Liquid handling device 4 is installed or removed by a lifting pipe 3 that is installed on bracket 5. In alternate embodiments a handle on liquid handling device 4 may be used for lifting liquid handling device 4 out of vault 8. Liquid handling device 4 may be any device connected to a pumping system such as, but not limited to, a pump, tank, meter, filter, valving, etc.

In the present embodiment, when lifting liquid handling device 4 out of vault 8, typical plumbing 7 is disconnected by quick connect shoe 6 and quick connect base 11 separating in a vertical direction. To install quick connect assembly with pumping device 4 into vault 8, the user slides quick connect assembly with liquid handling device 4 into the cavity of vault 8 in a vertical direction and aligns alignment feature 17 which guides quick connect shoe 6 into quick connect base 11, thereby enabling quick connect shoe 6 to enter quick connect base 11 and pressing down until bracket 5 and a base supporting bracket 10 touch. At this point, plumbing 7 is connected, allowing fluid to pass from liquid handling device 4 through plumbing 7 to quick connect through shoe 6 and base 11 and on to external plumbing 9.

External plumbing 9 enables items inside of vault 8 to be connected to mainlines outside of vault 8. In some embodiments, plumbing 7 may be modified to accept a miniature quick connector 7*a*, as shown by way of example in FIG. 6, which enables pressure regulation devices such as, but not limited to, gauges to be easily removed without removing liquid handling device 4 from vault 8. In other embodiments these regulation devices may be plumbed in direct without a quick connect when the servicing of the item is not an issue for example without limitation, with a pressure release valve. Items such as, but not limited to, pressure regulating valves, gate valves, ball valves, pressure relief valves and similar devices may be installed in plumbing 7 and external plumbing 9 as needed. These items can be installed at manufacture, in shop, or in the field as needed.

Figure 4:
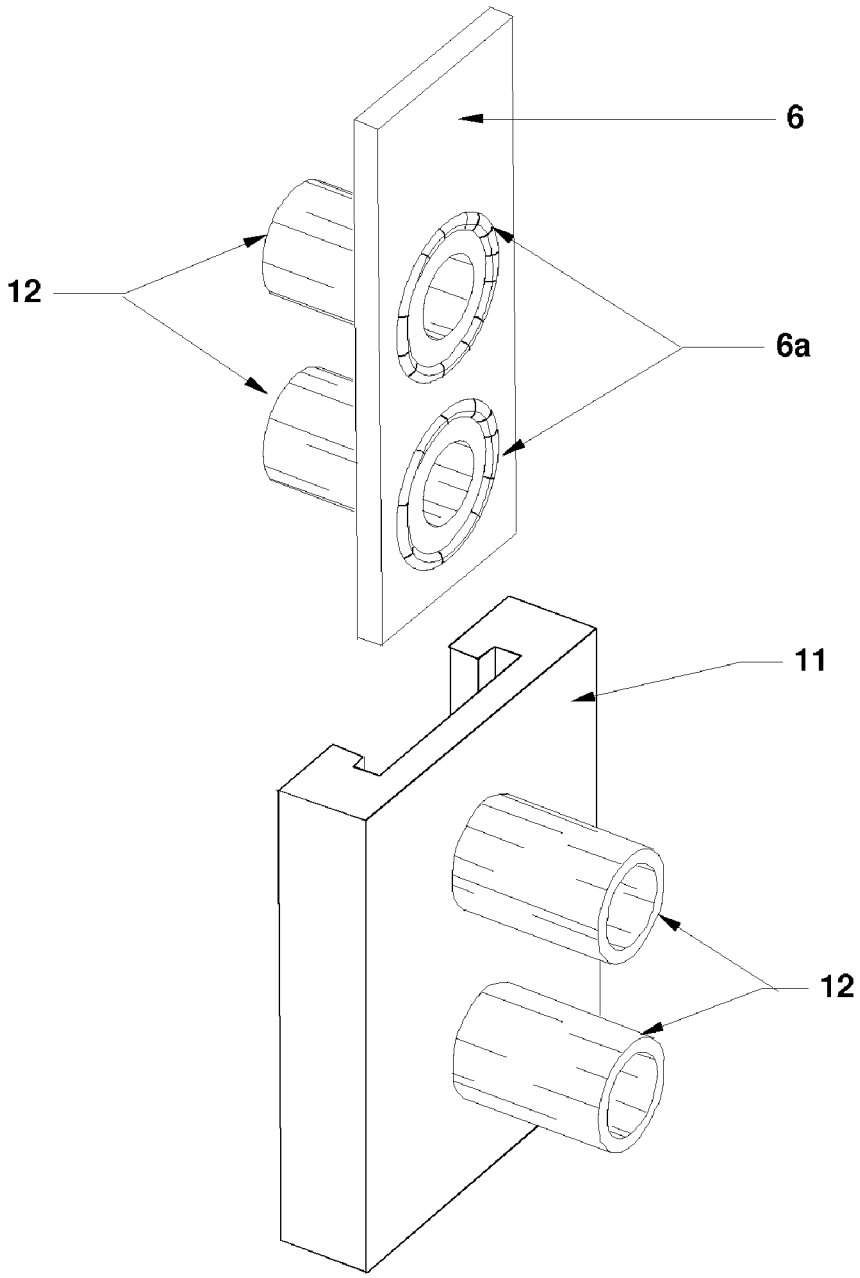
FIG. 4 illustrates a side perspective view of an exemplary quick connect adapter from a liquid handling system containment device, in accordance with an embodiment of the present invention.

FIG. 4 illustrates a side perspective view of an exemplary quick connect adapter from a liquid handling system containment device, in accordance with an embodiment of the present invention. In the present embodiment, the quick connect adapter comprises quick connect base 11 and quick connect shoe 6. Quick connect base 11 is a device that accepts quick connect shoe 6. Quick connect base 11 has a flat area that has on each edge a slotted perpendicular boss that holds and aligns holes in quick connect shoe 6 and holes in quick connect base 11 when properly installed. O-rings 6*a* in quick connect shoe 6 provide sealing to allow fluid to pass from quick connect base 11 to quick connect shoe 6 without leaking. O-rings 6*a* are set in a groove machined in quick connect shoe 6. Connection to quick connect shoe 6 and quick connect base 11 is accomplished with connectors 12 allowing pipe connection for controlled flow. Connectors 12 connect quick connect shoe 6 to plumbing 7 and quick connect base 11 to external plumbing 9, shown by way of example in FIGS. 1, 2, and 3. Connectors 12 may be threaded or plain end to be soldered or welded. Plumbing 7 and external plumbing 9 are fitted with conventional plumbing fittings such as, but not limited to, copper, galvanized steel, or plastic, to accommodate various apparatuses as liquid handling device 4. This plumbing may be done at the factory, on site, or in a shop.

Figure 5:
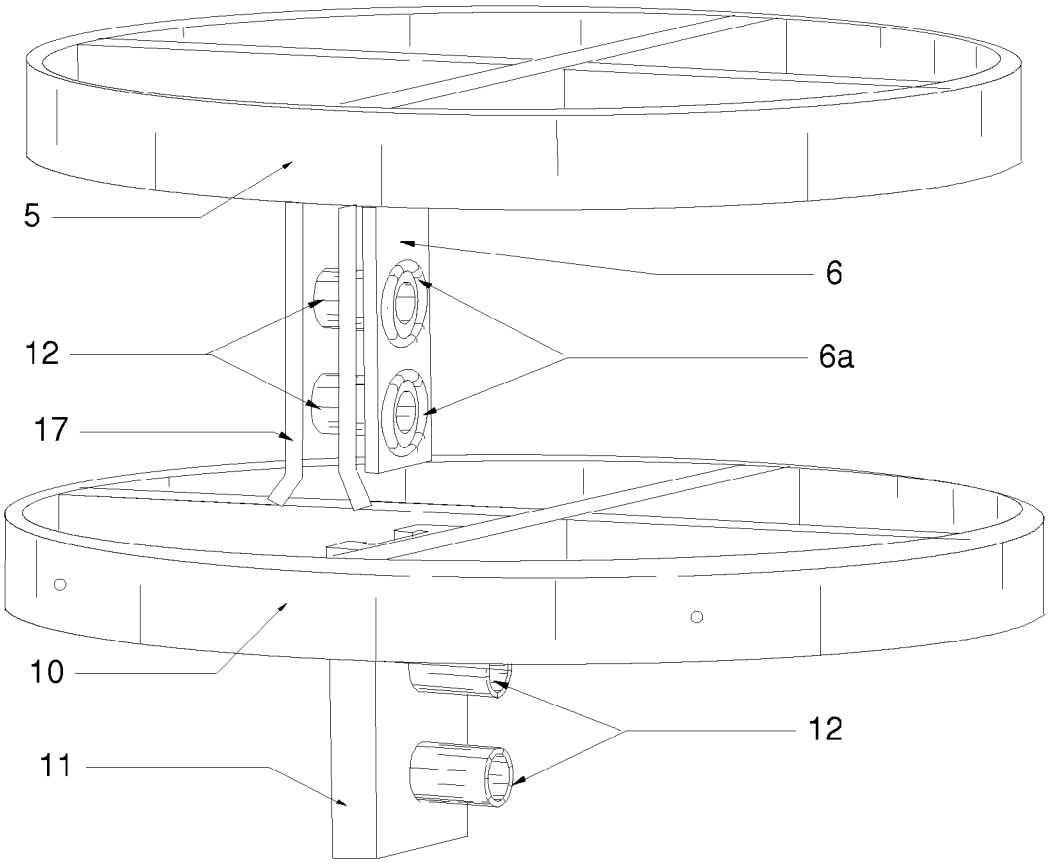
FIG. 5 illustrates a side perspective view of an exemplary quick connector assembly from a liquid handling system containment device, in accordance with an embodiment of the present invention.

FIG. 5 illustrates a side perspective view of an exemplary quick connector assembly from a liquid handling system containment device, in accordance with an embodiment of the present invention. In the present embodiment, quick connect shoe 6 and quick connect base 11 may be installed anywhere on bracket 5 and base supporting bracket 10 to accommodate various liquid handling devices. In alternate embodiments, more than one quick connect adapter may be installed if needed or desired. In some embodiments portions of the outer ring of bracket 5 may be cut away to facilitate clearance for items mounted on the wall of vault 8 during removal, for example, without limitation, controllers, switches, disconnects, J-boxes, etc.

Figure 6:
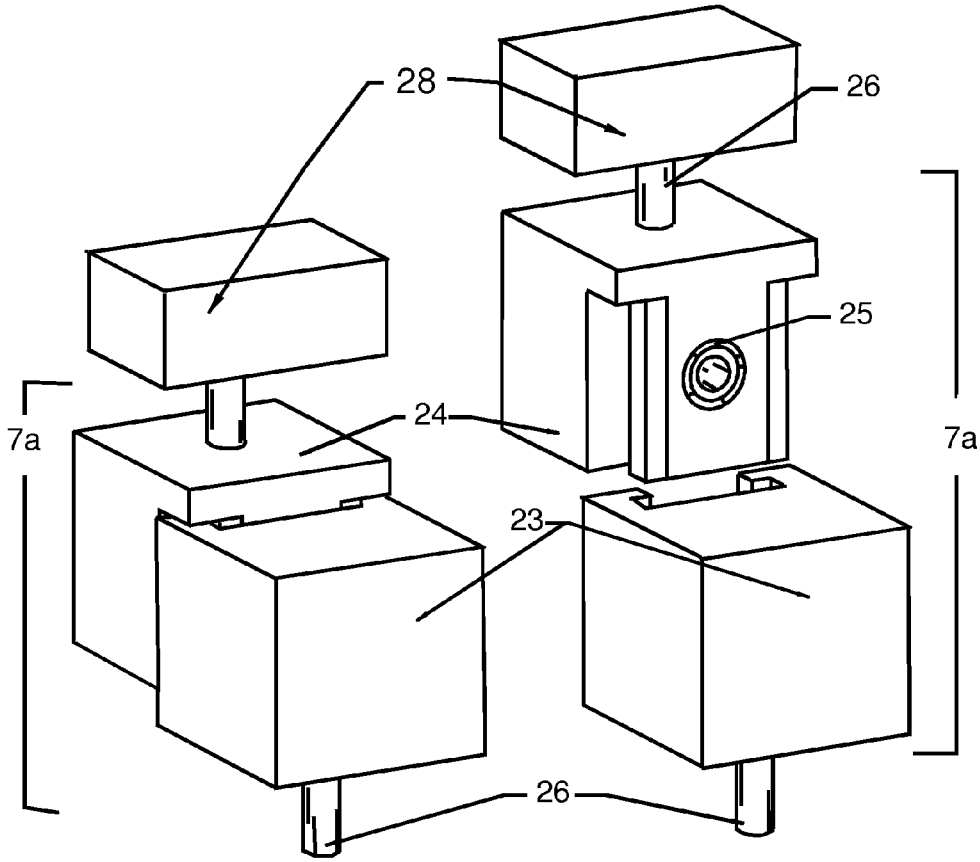
FIG. 6 illustrates a side perspective view and an exploded view of an exemplary optional quick connect assembly for a regulating device, in accordance with an embodiment of the present invention.

FIG. 6 illustrates a side perspective view and an exploded view of an exemplary optional quick connect assembly for a regulating device, in accordance with an embodiment of the present invention. Some embodiments of the present invention may have a small quick connector 7*a*, as shown by way of example in FIGS. 1 and 2. Quick connector 7*a* can be used to adapt pressure-regulating devices 28 to plumbing 7 and external plumbing 9, shown by way of example in FIGS. 1, 2, and 3. These pressure-regulating devices 28 may include, without limitation, pressure switches, gauges, transducers etc. Quick connector 7*a* enables these accessory devices 28 to be removed and serviced without removal of the main device.

In some embodiments these accessory devices 28 may also be connected by a small quick connect adapter similar to the quick connect adapter, shown by way of example in FIG. 6, connecting liquid handling device 4 to the plumbing of the vault assembly. This small quick connect adapter comprises a quick connect base 23 and a quick connect shoe 24. Quick connect base 23 and quick connect shoe 24 slide together to allow fluid to flow through to the accessory devices 28. O-rings 25 seal the connections between quick connect base 23 and quick connect shoe 24 to prevent leaking. O-rings 25 set in a grooves machined in quick connect shoe 24. Pipe nipples 26 adapt the plumbing from quick connect shoe 24 to the accessory device 28.

By constructing vault 8 from plastics or thin gauge metals, vault 8 can be delivered in a pickup truck or trailer and set into an existing ditch by one person, without lifting equipment or with minimal lifting equipment. Installation is very quick. The only water connections that require attention at installation are external plumbing 9 positioned outside of vault 8 below the freezing level. Vault 8 is designed to control fluids by minimizing or eliminating rainwater and groundwater from entering. However, caution must be used when installing vault 8 in high water tables. In these situations water removal means such as, but not limited to, drains, sump pumps, or holes may be used to drain or remove any fluids that enter vault 8. Vault 8 is installed in the ground after a waterline ditch has been dug, and water lines are connected to plumbing 9 at this time. A typical installation of vault assembly 20, according to the present embodiment, is as follows.

After the excavator digs ditches for vault 8 and lines, vault 8 is placed in the ditch. The ditch must be of adequate width and depth to enable vault 8 to be buried to the level of lid 1 at the point of installation. Water lines are then connected to external plumbing 9 at vault 8. Liquid handling device 4 can be in vault 8 at this time or may be installed into vault 8 after backfilling. If liquid handling device 4 is to be installed after backfilling, the excavator then backfills the ditch. Liquid handling device 4 along with bracket 4 is lowered into vault 8. Alignment feature 17 guides quick connect shoe 6 into quick connect base 11, and quick connect shoe 6 and quick connect base 11 are aligned. Bracket 4 with Liquid handling device 4 is then pushed into place. If electrical is needed, the electrical system is wired at this point. Lid 1 and fasteners 2 are then installed. If liquid handling device 4 requires service, fasteners 2 and lid 1 are removed and bracket 5 with liquid handling device 4 is lifted out of vault 8. Liquid handling device 4 may be serviced and then reinstalled into vault 8 as described above.

Liquid handling device 4 that is housed in vault 8 may be assembled at a factory, in a shop, or in the field by service personnel. In the present embodiment, all other components are comprised in vault 8. Electrical connections are preferably performed by an electrician. Controllers and other items such as, but not limited to switches, disconnects, J boxes, etc. may be installed on a post, inside vault 8, or inside other structures as preferred. Vault 8 has a plastic or metallic lid 1 that seals to vault 8 attached with fasteners 2 to supply security and safety. This design enables many different components to be installed in vault 8, for example, without limitation, pumps, meters, filters, pressure tanks, etc. The physical size of vault 8, quick connect shoe 6, and quick connect base 11, bracket 5 and base support bracket 10 can be changed to facilitate equipment of different sizes, for example, without limitation, larger tanks, pumps, filters, meters, etc. Special ordered systems can be built individually as needed.

Being able to install the vault assembly outside, according to the present embodiment, provides space saving in buildings where the liquid handling system is needed. However, in alternate embodiments, this vault assembly may be installed in the floor of structures if needed.

Figure 7:
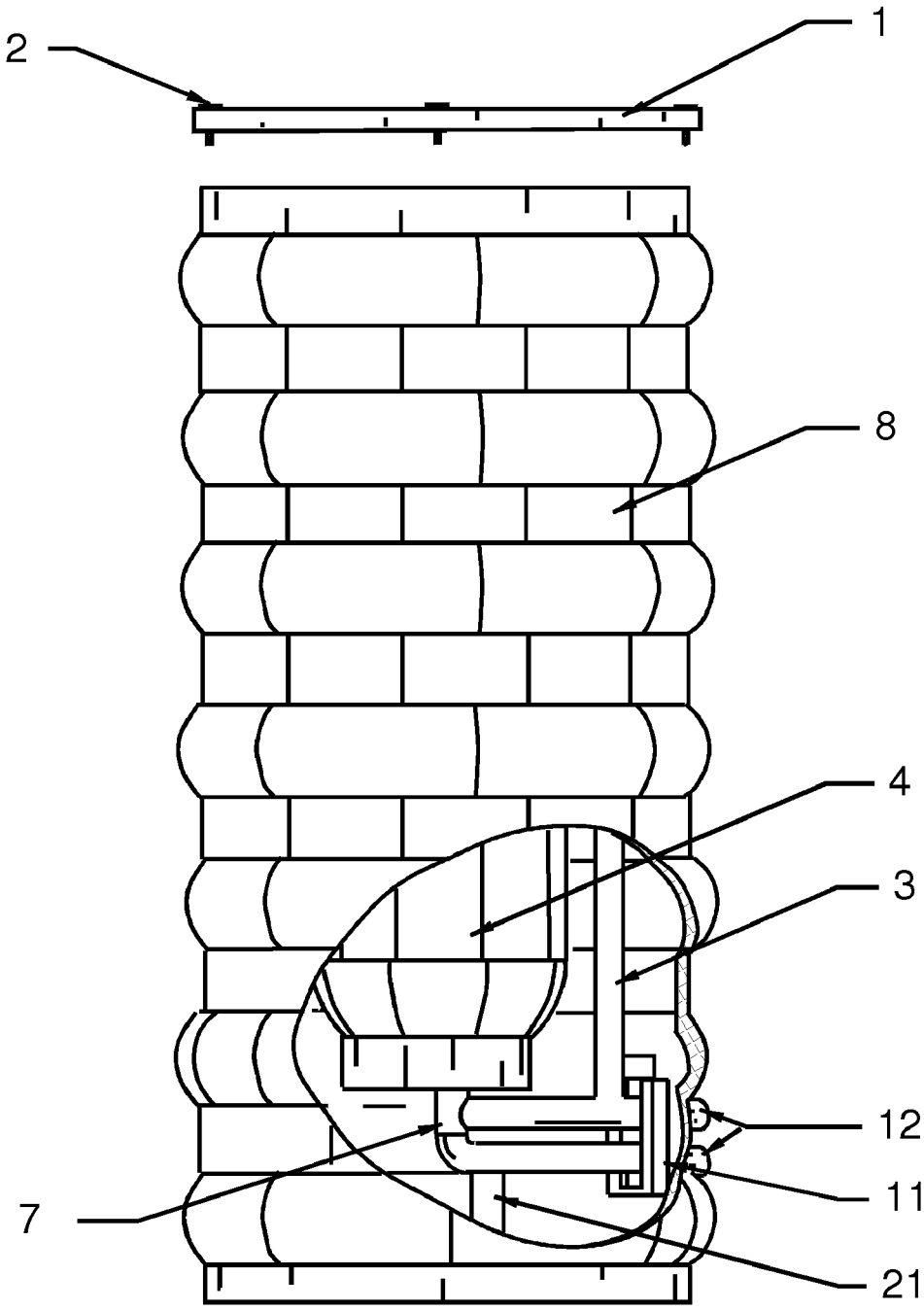
FIG. 7 illustrates a side view of vault 8 with cutaway showing Quick connect 6 and 11 mounted on sidwall of vault.

An embodiment of the invention may be configured to enable the component parts of the foregoing liquid handling device to be removable from the housing using the quick connect shoe 6 and base 11 mounted to the sidewall of Vault 8 without using brackets 5 an 10 as shown in FIG. 7 page 7 of 7. This solution functions best for small lighter system devices. A drawback of this solution is Quick connect shoe 6 and base 11 is not intended to suspend excessive weight of large devices. Also, the flex in the sidewall of the vault at mounting point can cause problems with the removal of the heavy devices. A support 21 has been added to minimize flexing issues in this configuration. Support 21 is attached to the plumbing 7. Support 21 rests on bottom of vault 8 to help support weight of device 4.

Having fully described at least one embodiment of the present invention, other equivalent or alternative means for implementing a containment device for a liquid handling system according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

What is claimed is:

1. A containment device for a liquid handling system, the device comprising:

a vault comprising a cavity for housing the liquid handling system, a closed bottom, sides and a top comprising an opening for enabling the liquid handling system to be installed and removed from said cavity;

a supporting device comprising a first half of a quick connect system connected to external plumbing, said first half of said quick connect system comprising a connector base comprising a flat plate with two openings for joining to said external plumbing on a first side, and slotted perpendicular bosses along two edges of a second side, said supporting device being positioned in a lower portion of said cavity and secured to said vault for supporting a weight of the liquid handling system;

a bracket comprising a second half of a quick connect system connected to internal plumbing for the liquid handling system, said second half of said quick connect system comprising: a connector shoe comprising a flat plate having two openings for joining to said internal plumbing on a first side of said connector shoe and for aligning with said two opening of said connector base, said flat plate being operable for sliding between said slotted perpendicular bosses of said connector base; and an O-ring type sealer circumferentially about each of said two openings on a second side of said connector shoe, said bracket configured to removably join to the liquid handling system, to rest on said supporting device when said bracket and the liquid handling system is lowered into said cavity, and to mate said first half and said second half of said quick connect system allowing liquid to flow between said external plumbing and said internal plumbing; and a lid securable to said top to cover said opening of said top for mitigating intrusion of environmental elements into said vault.

2. The device as recited in claim 1, further comprising an alignment feature, joined to said bracket and operable for engaging said supporting device during said lowering, for guiding said bracket to mate said first half and said second half of said quick connect system.

3. The device as recited in claim 1, in which said external plumbing is operable for attaching to mainlines outside said vault.

4. The device as recited in claim 1, further comprising fasteners for securing said lid to said top.

5. The device as recited in claim 1, in which said bracket removably joins to the liquid handling system by fastener means.

6. The device as recited in claim 1, in which said vault is constructed of a plastic material or galvanized steel.

7. The device as recited in claim 1, in which said lid is constructed of molded plastic or fabricated metal.

8. The device as recited in claim 1, further comprising an additional quick connect system joined to said bracket and connected to said internal plumbing for plumbing of regulation devices for the liquid handling system, where said regulation devices can be removed from said vault without removing the liquid handling system.

9. The device as recited in claim 8, in which said regulation device is a gauge.

10. The device as recited in claim 1, further comprising means for lowering and lifting said bracket and liquid handling system in said cavity.

11. The device as recited in claim 10, in which said means for lowering and lifting is a lifting pipe attached to said bracket.

12. The device as recited in claim 1, in which said vault is fabricated in a manner suitable for being buried below ground.

13. The device as recited in claim 12, in which said vault is further fabricated to minimize distortions from soil pressure.

* * * * *